US007001321B1

(12) United States Patent
Brown et al.

(10) Patent No.: US 7,001,321 B1
(45) Date of Patent: Feb. 21, 2006

(54) CARRIER FOR HOLDING A FLEXIBLE FLUID PROCESSING CONTAINER

(75) Inventors: Richard I. Brown, Northbrook, IL (US); Ying-Cheng Lo, Green Oaks, IL (US)

(73) Assignee: Baxter International Inc., Deerfield, IL (US)

( * ) Notice: Subject to any disclaimer, the term of this patent is extended or adjusted under 35 U.S.C. 154(b) by 0 days.

(21) Appl. No.: 09/050,614

(22) Filed: Mar. 30, 1998

(51) Int. Cl.
*B04B 7/12* (2006.01)

(52) U.S. Cl. ..... 494/18; 494/21; 494/44; 494/45

(58) Field of Classification Search ..... 494/18, 494/21, 44, 45; 210/781, 782
See application file for complete search history.

(56) References Cited

U.S. PATENT DOCUMENTS 3,674,197 A * 7/1972 Mitchell et al. ..... 494/17
4,387,848 A 6/1983 Kellogg et al.
4,430,072 A 2/1984 Kellogg et al.
4,439,178 A 3/1984 Mulzet
4,445,883 A * 5/1984 Schroendorfer ..... 494/21
4,447,221 A 5/1984 Mulzet
4,714,457 A * 12/1987 Alterbaum ..... 494/37
4,892,668 A * 1/1990 Harmony et al. ..... 210/782
5,322,620 A 6/1994 Brown et al.
5,360,542 A 11/1994 Williamson, IV et al.
5,549,540 A * 8/1996 Moore et al. ..... 494/20
5,551,942 A 9/1996 Brown et al.
5,573,678 A 11/1996 Brown et al.
5,720,716 A 2/1998 Blakeslee et al.

* cited by examiner

*Primary Examiner*—Matthew O. Savage
(74) *Attorney, Agent, or Firm*—Bradford R. L. Price; Daniel D. Ryan

(57) ABSTRACT

A fluid processing assembly can be easily inserted into and removed from a rotatable centrifuge channel. The processing assembly comprises a processing container and a carrier. The processing container has flexibility and, in use, occupies the channel to receive fluids for separation in the centrifugal field. The carrier retains the processing container outside the channel in a flexed condition conforming to the channel. The carrier resists deformation of the processing container during its insertion into or removal from the channel.

2 Claims, 14 Drawing Sheets

CARRIER FOR HOLDING A FLEXIBLE FLUID PROCESSING CONTAINER

FIELD OF THE INVENTION

The invention relates to blood processing systems and apparatus.

BACKGROUND OF THE INVENTION

Today, people routinely separate whole blood by centrifugation into its various therapeutic components, such as red blood cells, platelets, and plasma.

Conventional blood processing methods use durable centrifuge equipment in association with single use, sterile processing systems, typically made of plastic. The operator loads the disposable systems upon the centrifuge before processing and removes them afterwards.

The centrifuge chamber of many conventional centrifuges takes the form of a relatively narrow arcuate slot or channel. Loading a flexible processing container inside the slot prior to use, and unloading the container from the slot after use, can often be time consuming and tedious.

SUMMARY OF THE INVENTION

The invention makes possible improved liquid processing systems that provide easy loading and unloading of disposable processing components. The invention achieves this objective without complicating or significantly increasing the cost of the disposable components. The invention allows relatively inexpensive and straightforward disposable components to be used.

The invention provides a processing assembly for insertion into and removal from a channel which, in use, is rotated to create a centrifugal field. The processing assembly comprises a generally flexible processing container and a carrier, to which the processing container is attached. The carrier shapes the processing container to generally match the configuration of the channel. The carrier limits deformation of the processing container during its insertion into and removal from the channel. Inside the channel, the processing container receives fluids, e.g., blood, for separation in the centrifugal field.

The features and advantages of the invention will become apparent from the following description, the drawings, and the claims.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF THE PREFERRED EMBODIMENTS

Figure 1:
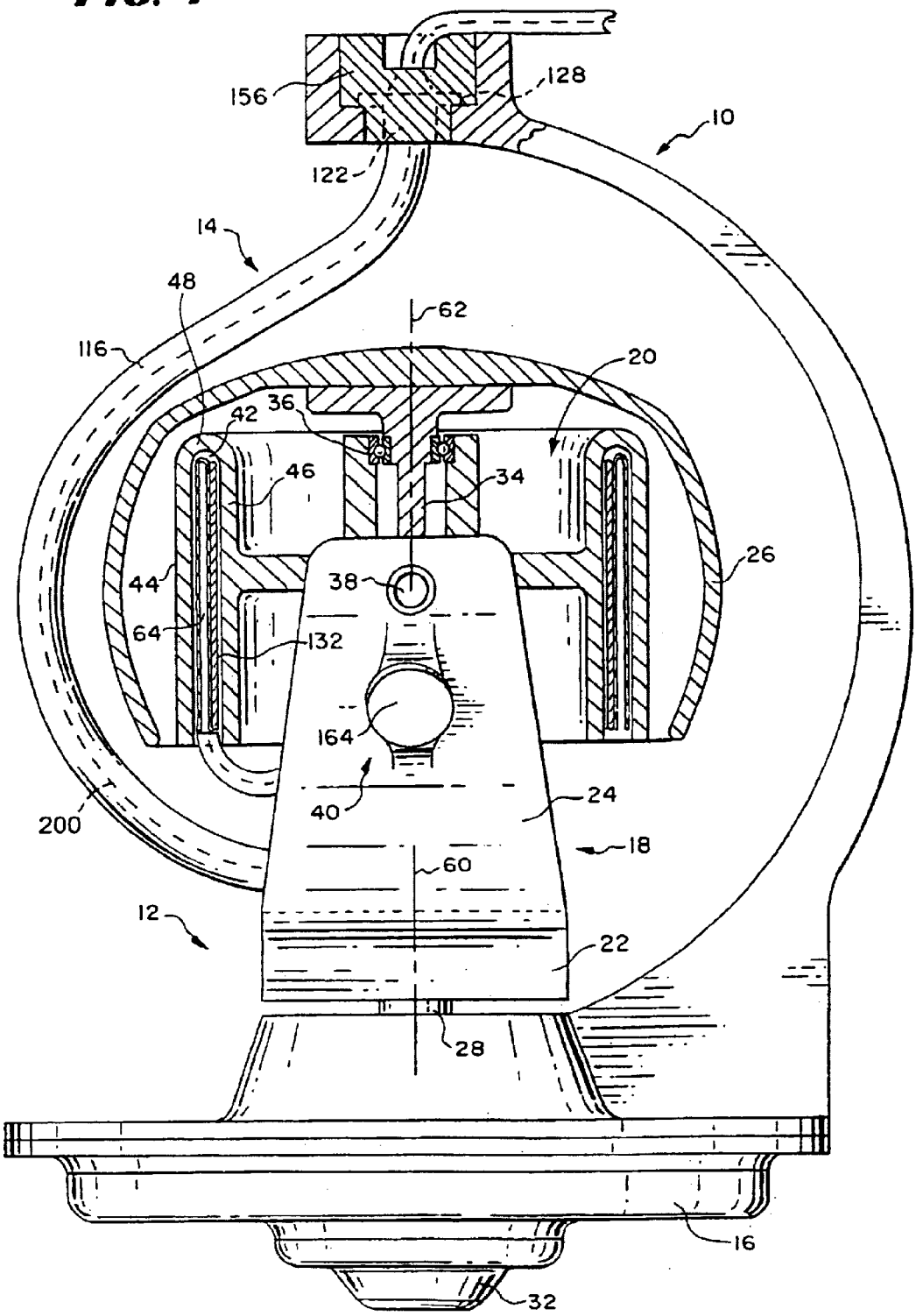
FIG. 1 is a side view, partly in section, of a centrifuge having a channel into which a flexible processing container carried by a generally stiff carrier have been inserted for use, the centrifuge being shown in an operational condition.
Figure 2:
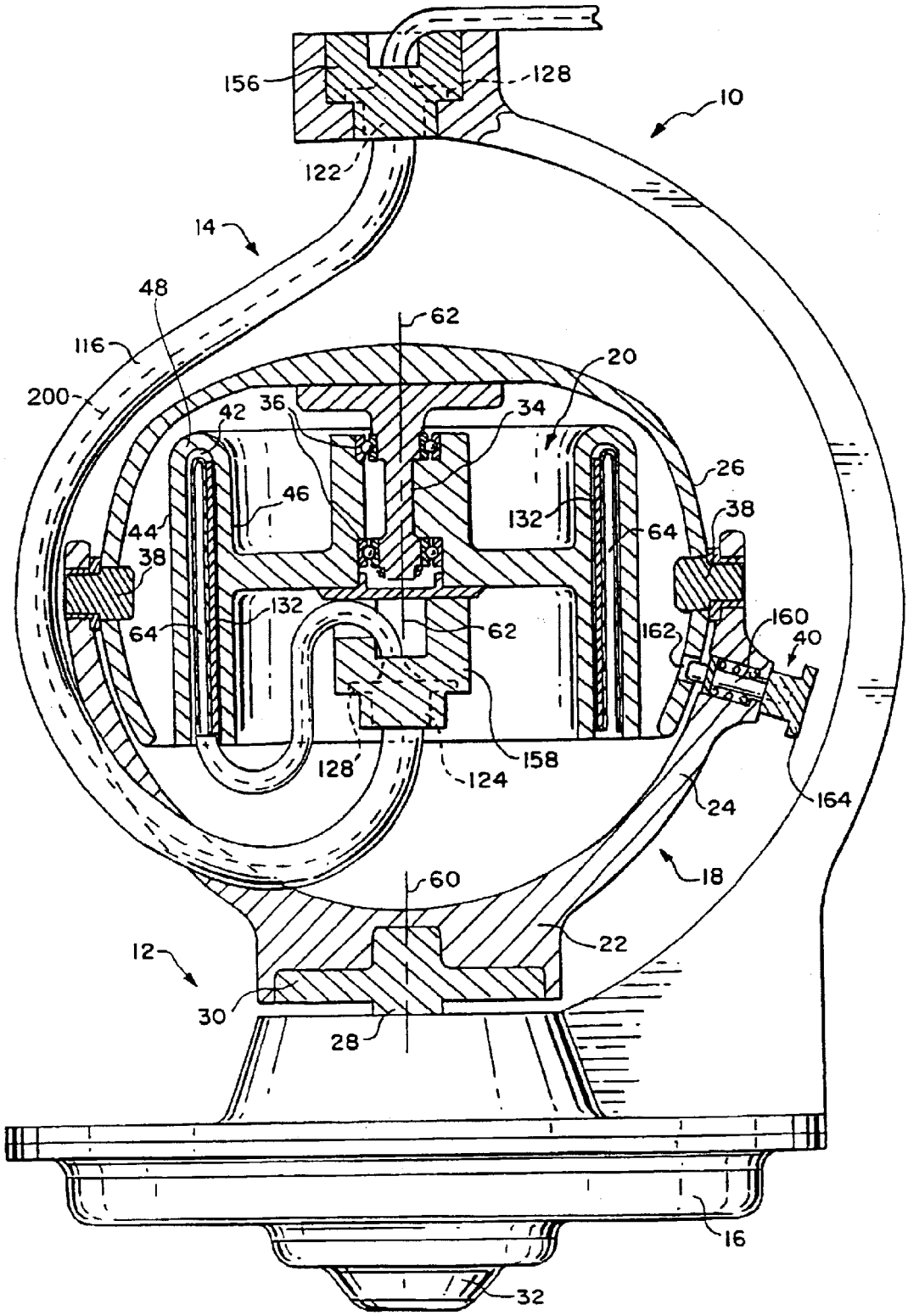
FIG. 2 is a side view of the centrifuge shown in FIG. 1, also partly in section, having been rotated by about 90° to reveal other structural features not shown in FIG. 1.

FIGS. 1 and 2 show a centrifugal processing system 10 that embodies the features of the invention. The system 10 can be used for processing various fluids. The system 10 is particularly well suited for processing whole blood and other suspensions of biological cellular materials. Accordingly, the illustrated embodiment shows the system 10 used for this purpose.

The system 10 includes a centrifuge assembly 12 and a fluid processing assembly 14, which is used in association with the centrifuge assembly 12, as FIGS. 1 and 2 show. The centrifuge assembly 12 is intended to be a durable equipment item capable of long term use. The fluid processing assembly 14 is intended to be a single use, disposable item, which is loaded into the centrifuge assembly 12 at time of use and unloaded and discarded after use.

A stationary platform 16 carries the rotating components of the centrifuge assembly 12. The rotating components of the centrifuge assembly 12 include a yoke assembly 18 and a chamber assembly 20.

The yoke assembly 18 includes a yoke base 22, a pair of upstanding yoke arms 24 (best shown in FIG. 2), and a yoke bowl 26. The yoke base 22 is attached to a first axle 28, which spins on a bearing element 30 about the stationary platform 16. An electric drive 32, e.g., a permanent magnet, brushless DC motor, rotates the yoke assembly 18 on the first axle 28.

Figure 3:
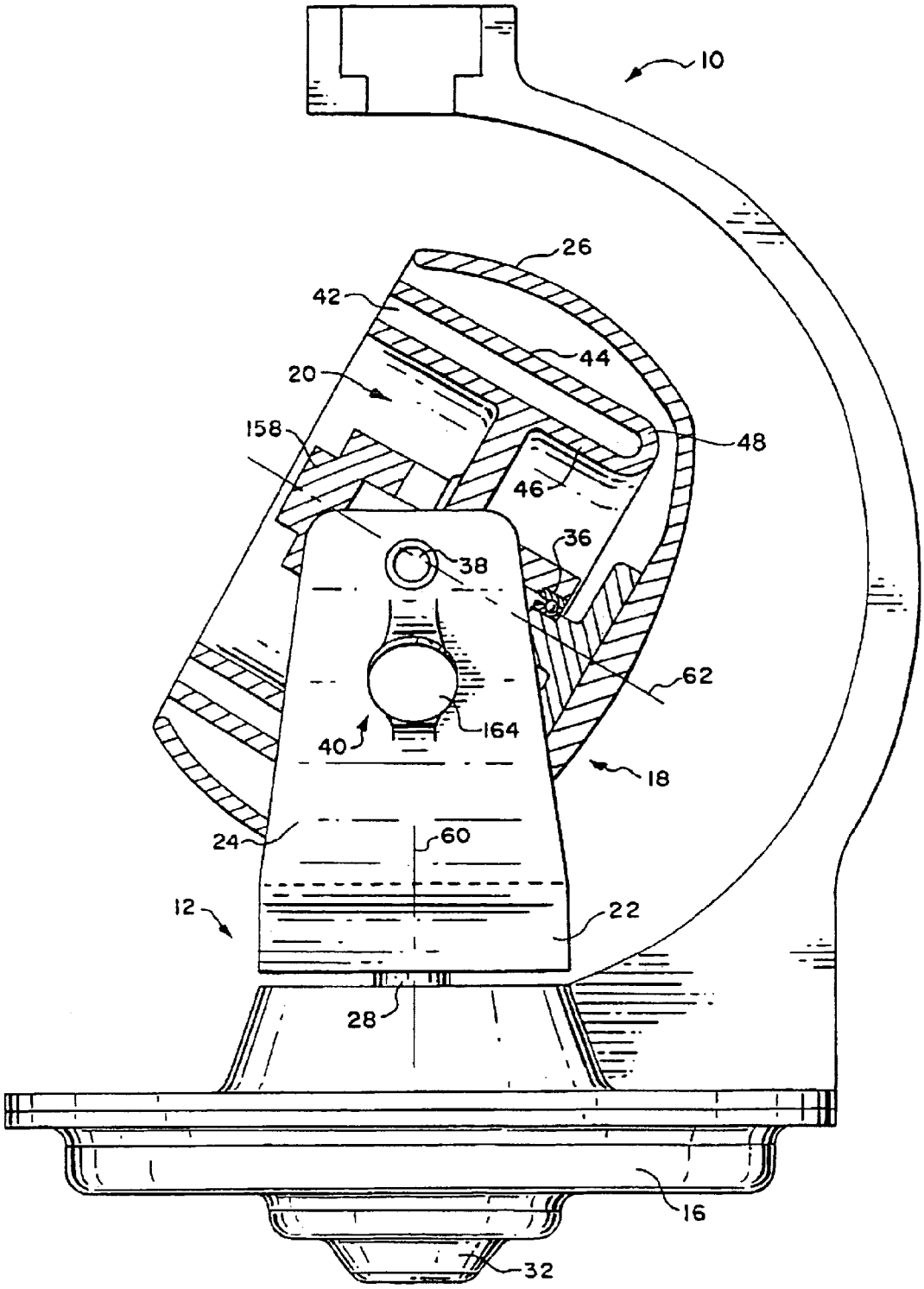
FIG. 3 is a side view, partly in section, of the centrifuge shown in FIG. 1, except that the channel has been swung upward to receive the flexible processing container and carrier as a unit.

The chamber assembly 20 is attached to a second axle 34, which spins on a bearing element 36 within the yoke bowl 26. The yoke bowl 26 is pivotally carried by pins 38 on the yoke arms 24. The yoke bowl 26 and, with it, the chamber assembly 20 it carries, swing as a unit on the pins 38 between a downward facing position for operation (shown in FIGS. 1 and 2) and an upward facing position for loading the fluid processing assembly 14 (shown in FIG. 3). FIG. 3 shows the centrifuge assembly 12 before loading in the fluid processing assembly 14, whereas FIGS. 1 and 2 show the centrifuge assembly 12 after loading in the fluid processing assembly 14.

A latch mechanism 40 releasably locks the yoke bowl 26 in the downward operating position. When the yoke bowl 26 is in the downward operating position, the axis of rotation 60 for the yoke assembly 18 (about axle 28) is generally aligned with the axis of rotation 62 of the chamber assembly 20 (about the axle 34).

The latch mechanism 40 can take various forms. In the illustrated embodiment (see FIG. 2), a pin 160 is carried by the yoke arm 24. The pin 160 is spring-biased to normally project into a key way 162 in the yoke bowl 26 when the yoke bowl 26 is located in its downward operating position. The interference between the pin 160 and the key way 162 retains the yoke bowl 26 in the downward position. The pin 160 includes a handle end 164, allowing the operator to manually pull the pin 160 outward, against its spring bias. This frees the pin 160 from the key way 162. With the pin 160 withdrawn, the operator can pivot the yoke bowl 26 into its upward facing position.

The chamber assembly 20 includes an arcuate channel 42, which is defined between an outer wall 44, an inner wall 46, and a bottom wall 48. The channel 42 spins about the rotational axis 62. During rotation, the outer wall 44 becomes a high-G wall and the inner wall 46 becomes a low-G wall. The high-G wall and low-G wall together define the high and low limits of the centrifugal field.

The fluid processing assembly 14 includes a disposable processing container 64, which, in use, is carried within the channel 42 for common rotation, as FIGS. 1 and 2 show. While rotating with the channel 42, fluids introduced into the container 64 separate as a result of centrifugal forces. Once the separation procedure is completed, the processing chamber 64 is intended to be removed from the channel 42 and disposed of.

The construction of the processing container 64 can vary, according to the separation objectives. In the illustrated embodiment, the container 64 is used to separate packed red blood cells (PRBC) and platelet-rich plasma (PRP) from whole blood (WB) drawn from a donor.

Figure 4:
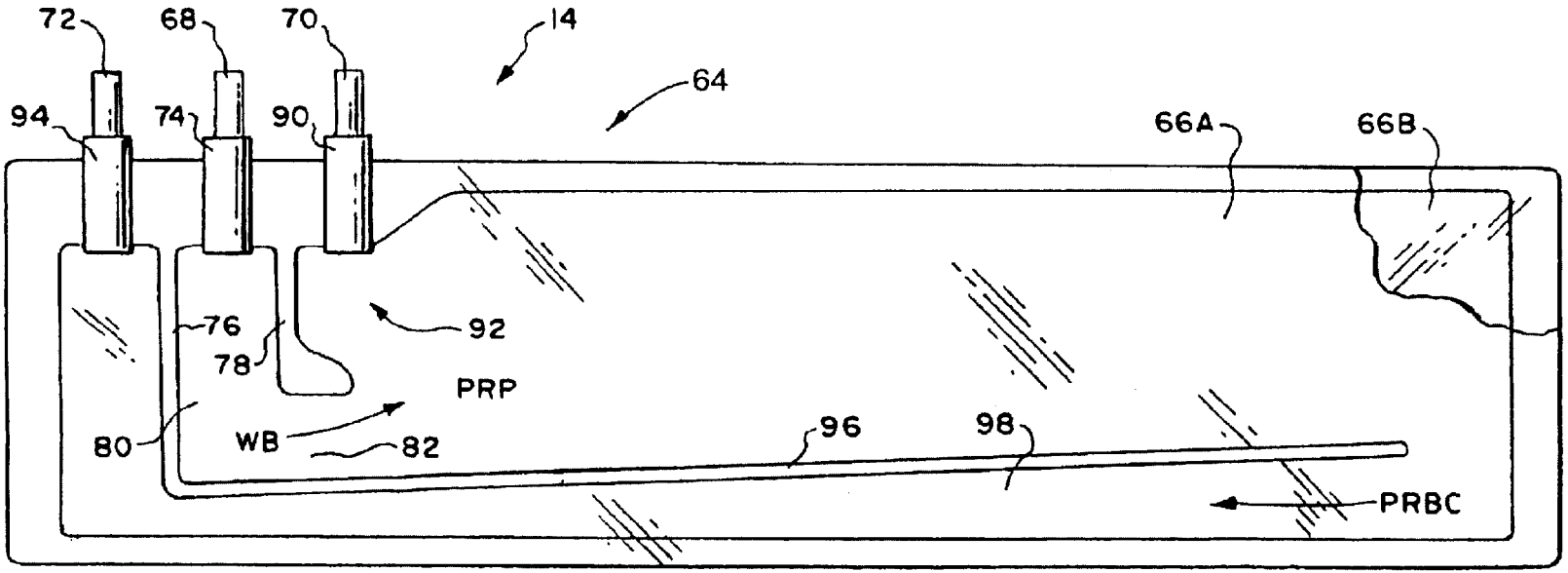
FIG. 4 is a front plan view of the flexible processing container shown in FIG. 1.

With this separation objective in mind (see FIG. 4), the processing container 64 comprises two elongated sheets 66A and 66B of a flexible, biocompatible plastic material, such as plasticized medical grade polyvinyl chloride, heat sealed together about their periphery. The fluid processing assembly 14 includes three tubing branches 68, 70, and 72 that communicate directly with the processing container 64. In the illustrated embodiment, the tubing branches 68, 70, and 72 are integrally connected to the processing container 64, so that the processing assembly 14 can be manufactured as a sterile, closed system.

The first tubing branch 68 carries WB through an inlet port 74 into the container 64. The container 64 includes interior seals 76 and 78, which form a WB inlet passage 80 that leads into a WB entry region 82. WB follows a circumferential flow path in the container 64, as it spins inside the channel 42 about the rotational axis 62. The side walls of the containers 64 expand within the confines of the channel 42 against the low-G wall 46 and high-G wall 44.

Figure 5:
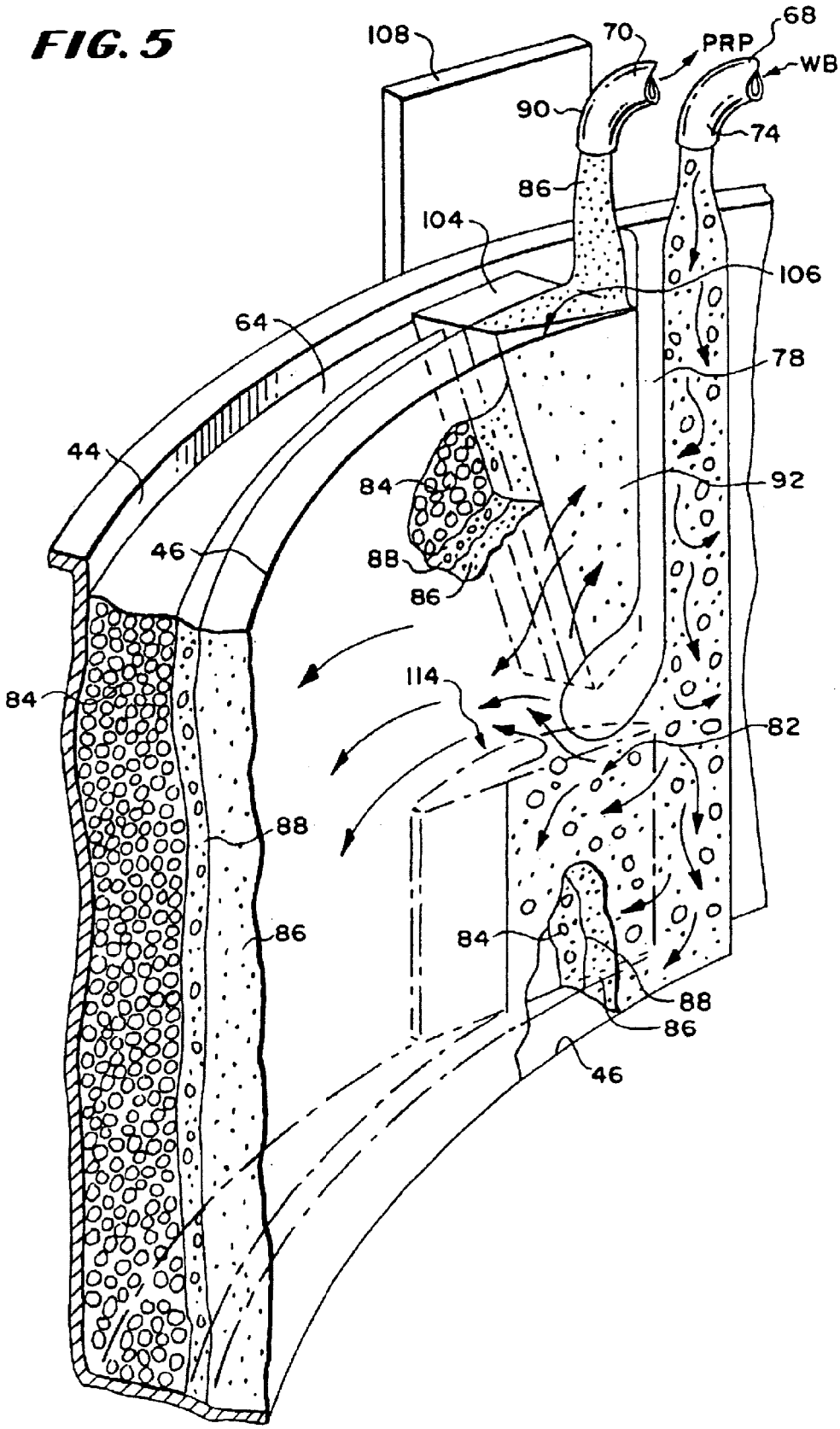
FIG. 5 is a schematic, perspective view of the interior of the processing container shown in FIG. 4, showing details of the separation of whole blood into red blood cells and platelet-rich plasma in the whole blood entry region of the container.

As FIG. 5 shows, WB separates in the centrifugal field within the container 64 into PRBC 84, which move toward the high-G wall 44, and PRP 86, which are displaced by movement of the PRBC 84 toward the low-G wall 46. An intermediate layer 88, called the interface, forms between the PRBC 84 and PRP 86.

The second tubing branch 70 carries separated PRP through a first outlet port 90 from the container 64. The interior seal 78 also creates a PRP collection region 92 in the container 64. The PRP collection region 92 is adjacent to the WB entry region 82. The velocity at which the PRBC 84 settle toward the high-G wall 44 in response to centrifugal force is greatest in the WB entry region 82 than elsewhere in the container 64. There is also relatively more plasma volume to displace toward the low-G wall 46 in the WB entry region 82. As a result, relatively large radial plasma velocities toward the low-G wall 46 occur in the WB entry region 82. These large radial velocities toward the low-G wall 46 elute large numbers of platelets from the PRBC 84 into the close-by PRP collection region 92, for collection through the second tubing branch 70.

The third tubing branch 72 carries separated PRBC 84 through a second outlet port 94 from the container 64. The interior seal 76 also forms a dog-leg 96 that defines a PRBC collection passage 98. A stepped-up barrier 100 (see FIG. 6) extends into the PRBC mass along the low-G wall 46, creating a restricted passage 102 between it and the facing high-G wall 44. The restricted passage 102 allows PRBC present along the high-G wall 44 to move beyond the barrier 100 into the PRBC collection passage 98 to the PRBC port 94. Simultaneously, the stepped-up barrier 100 blocks the passage of the PRP beyond it.

Figure 8:
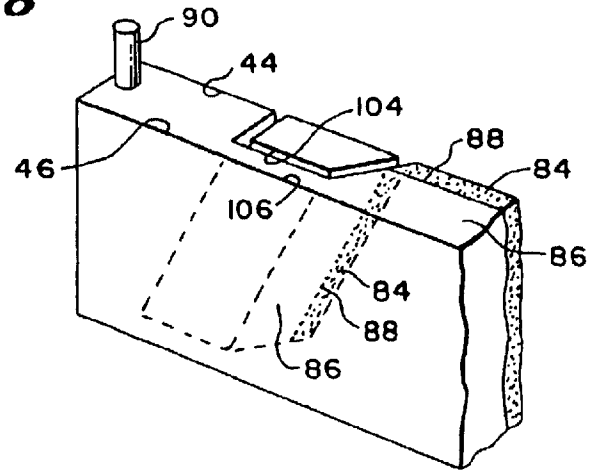
FIGS. 7 and 8 are perspective views, taken along the low-G side of the channel, showing further details of one of the contours shown in FIG. 6, which comprises an inclined ramp used to help govern the collection of platelet-rich plasma from the container.
Figure 7:
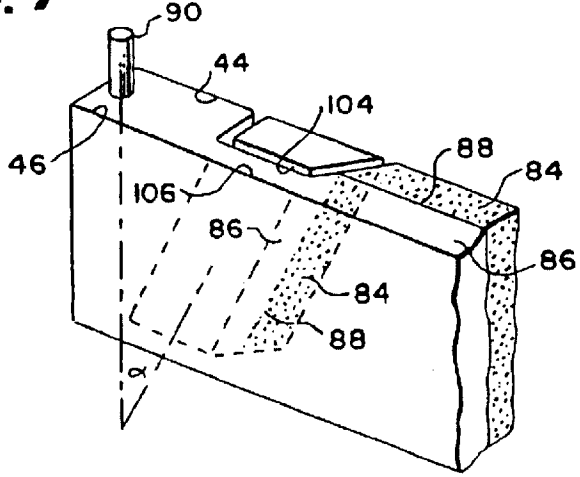

As FIGS. 5, 7, and 8 show, the high-G wall 44 also projects toward the low-G wall 46 to form a tapered ramp 104 in the PRP collection region 92. The ramp 104 forms a constricted passage 106 along the low-G wall 46, along which the PRP 86 extends. The ramp 104 keeps the interface 88 and PRBC 84 away from the PRP collection port 90, while allowing PRP 86 to reach the PRP collection port 90.

In the illustrated embodiment (see FIG. 7), the ramp 104 is oriented at a non-parallel angle $\alpha$ of less than 45° (and preferably about 30°) with respect to the axis of the PRP port 90. The angle $\alpha$ mediates spill-over of the interface 88 and PRBC 84 through the constricted passage 106.

As FIGS. 7 and 8 show, the ramp 104 also displays the interface 88 for viewing through a side wall of the container 64 by an associated interface controller 108 (shown schematically in FIG. 5). The interface controller 108 controls the relative flow rates of WB, PRP, and PRBC through their respective ports 74, 90, and 94. In this way, the controller 108 maintains the interface 88 at a prescribed control location on ramp 104 close to the constricted passage 106 (as FIG. 7 shows), and not spaced away from the constricted passage 106 (as FIG. 8 shows). The controller 108 thereby controls the platelet content of the PRP collected through the port 90. The concentration of platelets in the plasma increases with proximity to the interface 88. By maintaining the interface 88 at a high position on the ramp 104 (as FIG. 7 shows), the plasma conveyed by the port 90 is platelet-rich.

Further details of a preferred embodiment for the interface controller are described in U.S. Pat. No. 5,316,667, which is incorporated herein by reference.

Figure 6:
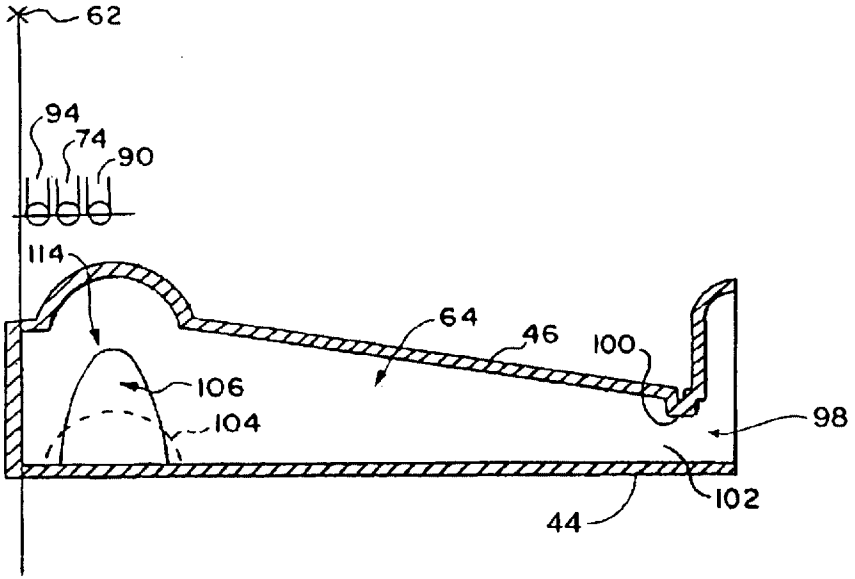
FIG. 6 is a top sectional view of the processing container shown in FIG. 4, showing various contours formed along the high-G and low-G sides of the separation zone to enhance centrifugal separation of blood.

As FIG. 5 and 6 show, radially opposed surfaces in the container 64 form a flow-restricting region 114 along the high-G wall 44 of the WB entry region 82. The region 114 restricts WB flow in the WB entry region 82 to a reduced passage, thereby causing more uniform perfusion of WB into the container 64 along the low-G wall 46. The constricted region 114 also brings WB into the entry region 82 at approximately the preferred, controlled height of the interface 88 on the ramp 104.

Figure 9:
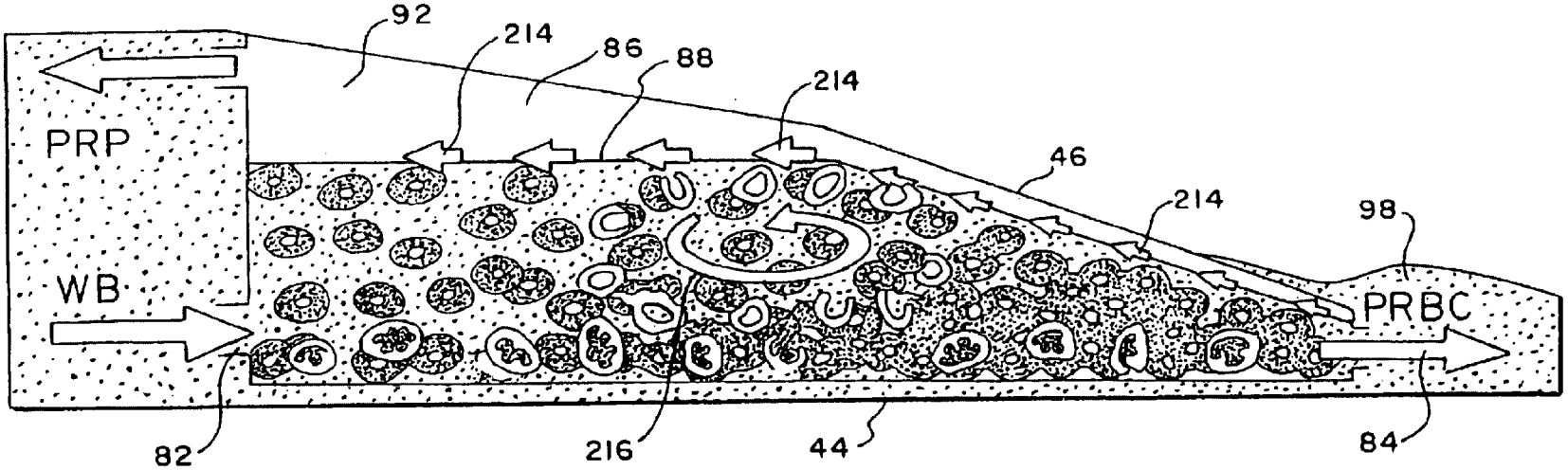
FIG. 9 is a schematic view of the separation of blood within the processing container shown in FIG. 4, showing the dynamic flow conditions which the various contours shown in FIG. 6 develop.

As FIG. 6 shows, the low-G wall 46 tapers outward away from the axis of rotation 62 toward the high-G wall 44 in the direction of WB flow, while the facing high-G wall 44 retains a constant radius. The taper can be continuous (as FIG. 6 shows) or can occur in step fashion. These contours along the high-G and low-G walls 44 and 46 produce a dynamic circumferential plasma flow condition generally transverse the centrifugal force field in the direction of the PRP collection region 92. As depicted schematically in FIG. 9, the circumferential plasma flow condition in this direction (arrows 214) continuously drags the interface 88 back toward the PRP collection region 92, where the higher radial plasma flow conditions already described exist to sweep even more platelets off the interface 88. Simultaneously, the counterflow patterns (arrow 216) serve to circulate the other heavier components of the interface 88 (the lymphocytes, monocytes, and granulocytes) back into the PRBC mass, away from the PRP stream.

Figure 10:
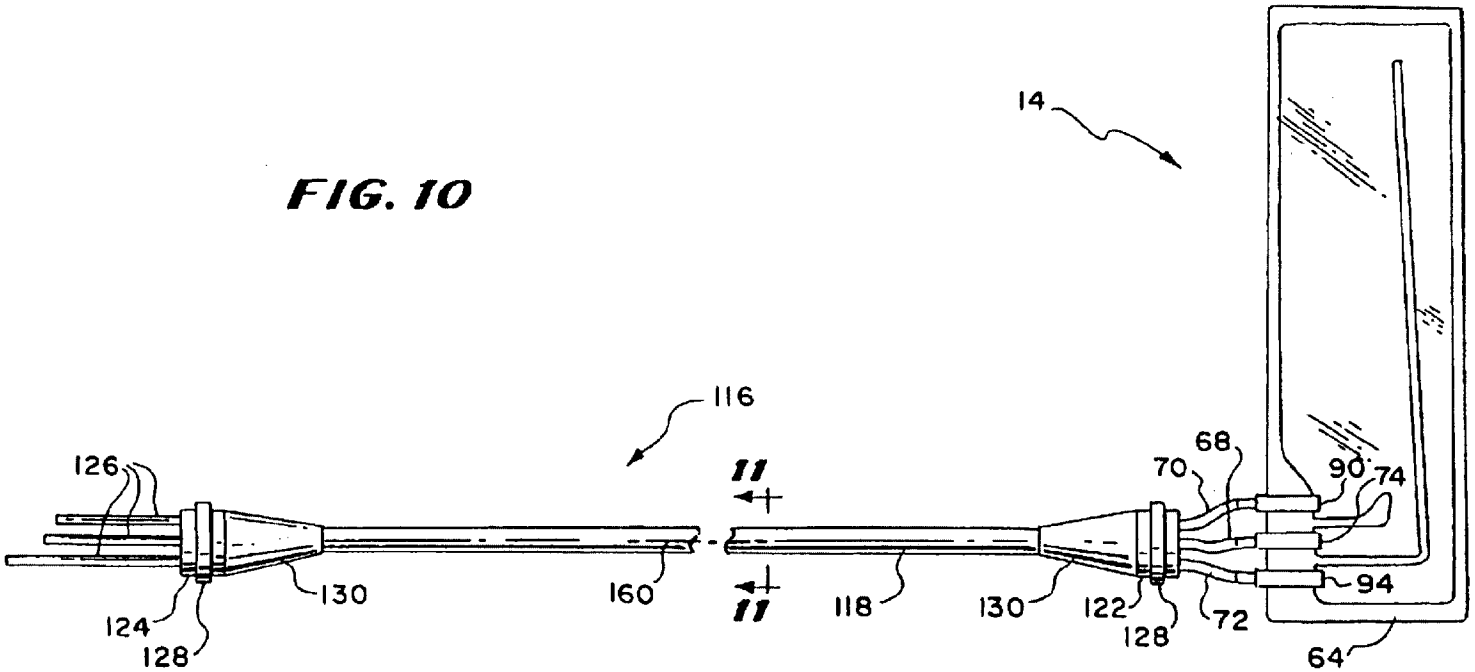
FIG. 10 is a plan view of the processing container shown in FIG. 4 with an integrally attached, multiple lumen umbilicus to conduct fluids to and from the container in a seal less system.
Figure 11:
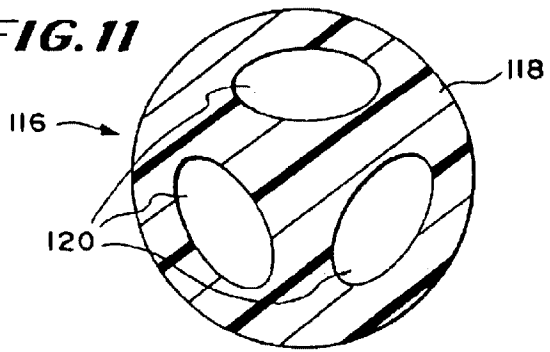
FIG. 11 is a section view of the umbilicus taken generally along line 11—11 in FIG. 10.

As FIG. 10 best shows, the three tubing branches 68, 70, and 72 are coupled to an umbilicus 116. As FIG. 11 shows, the umbilicus 116 includes a coextruded main body 118 containing three interior lumens 120, which each communicates with one of the tubing branches 68, 70, and 72. The main body 118 is made, e.g., from HYTREL® 4056 Plastic Material (DuPont), which withstands high speed flexing.

As FIG. 10 shows, an upper support block 122 and a lower support block 124 are secured, respectively, to opposite ends of the umbilicus body 118. Each support block 122 and 124 is made, e.g., of a HYTREL® 8122 Plastic Material (DuPont), which are injection over-molded about the main umbilicus body 118. The over-molded blocks 122 and 124 include formed lumens, which communicate with the three umbilicus lumens 120. The three tubing branches 68, 70, and 72 (made from polyvinyl chloride material) are solvent bonded to the upper block 122 in communication with the umbilicus lumens 120. Additional tubing branches 126 (also made from polyvinyl chloride material) are solvent bonded to the lower block 124 in communication with the umbilicus lumens 120. The additional tubing branches 126, in use, are placed in operative association with conventional peristaltic pumps, sensors, and clamps (not shown).

As further shown in FIG. 10, each support block 122 and 124 preferably includes an integral, shaped molded flange 128, to aid the installation of the umbilicus 116 on the centrifuge assembly 12, as will be described later. Each support block 122 and 124 further includes a tapered sleeve 130, which act as strain relief elements for the umbilicus 116 during use.

Figure 12A:
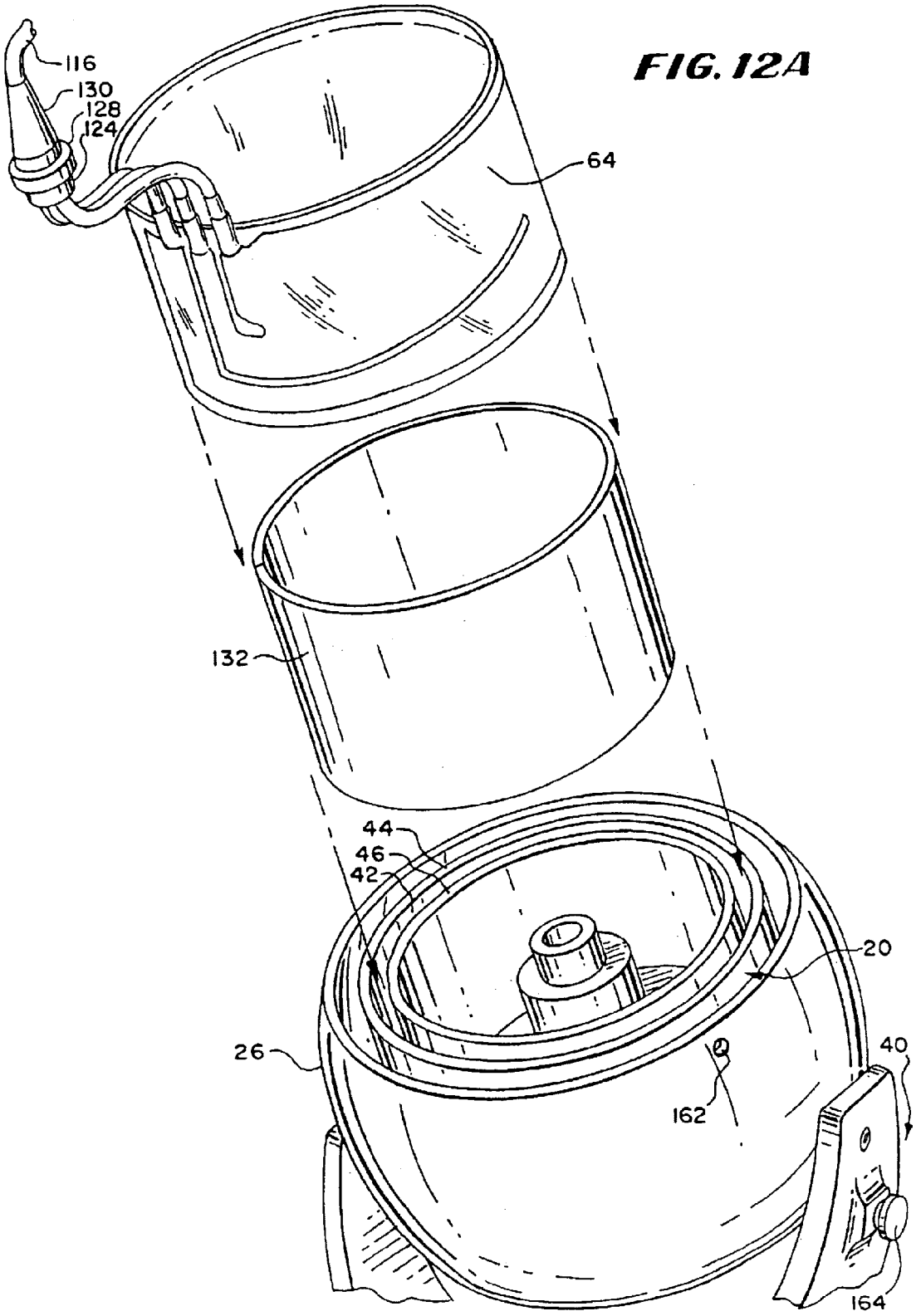
FIG. 12A is a perspective, exploded view of the processing container and a generally stiff carrier, which aids its insertion into and removal from the channel of the centrifuge shown in FIG. 1.
Figure 12B:
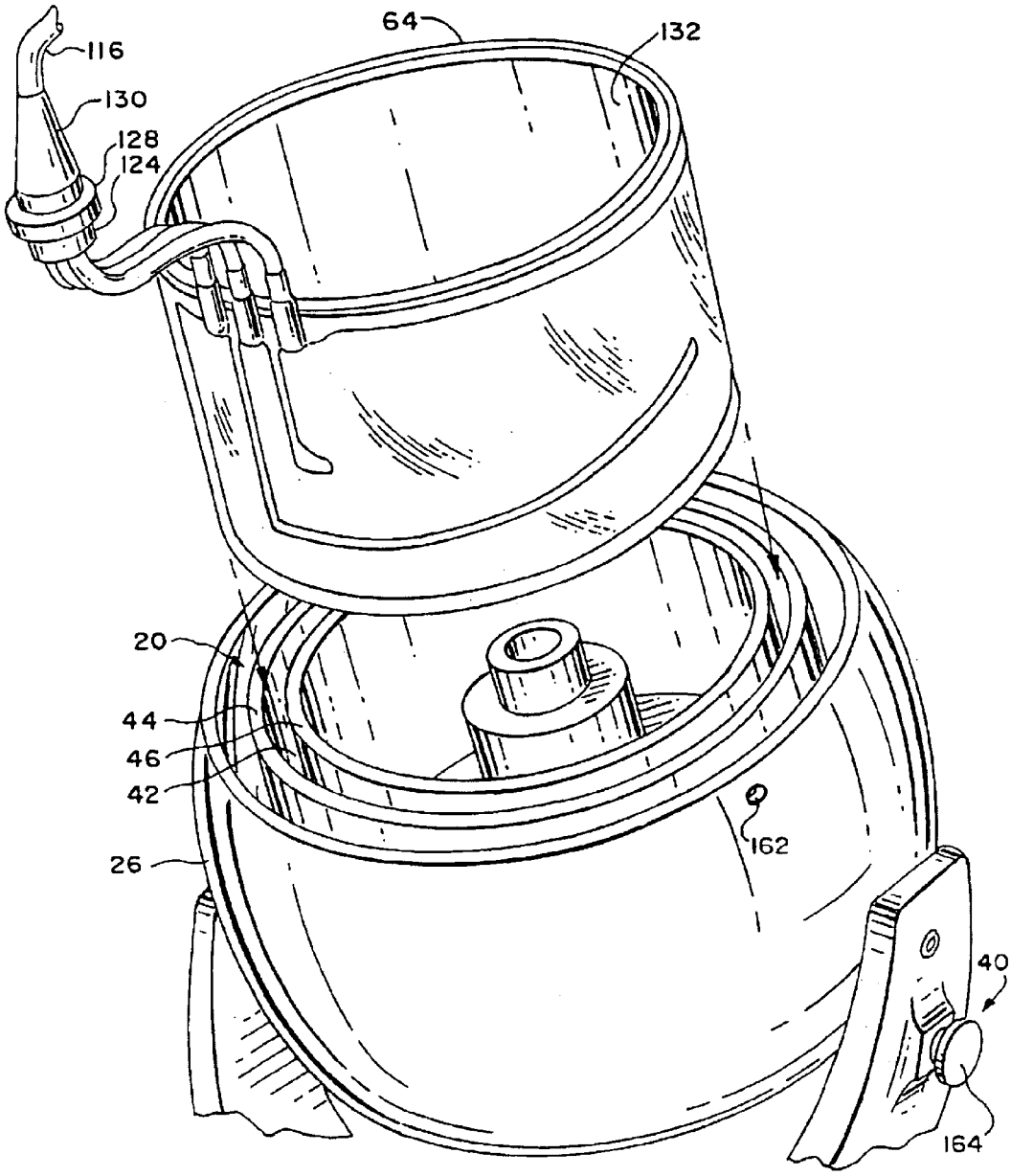
FIG. 12B is a perspective, assembled view of the processing container and carrier shown in FIG. 12A.

As FIGS. 12A and 12B show, in the illustrated and preferred embodiment, the flexible processing container 64 is attached to a carrier 132. The carrier 132 possesses mechanical properties that limit deformation of the shape of the carrier 32 when subject to linear compression forces. The carrier 32 can be formed, e.g., from molded plastic, thermally formed material vacuum-formed plastic, cardboard, or paper. The processing container 64 is secured to the carrier 132, e.g., by pinning, gluing, taping, or welding.

As FIG. 12B shows, the carrier 132 can be shaped to nest within the channel 64. The carrier provides an added degree of stiffness during handling to aid in the insertion of the processing container 64 into the channel 42, as well as the removal of the container 64 from the channel 42, without undue bending or shape deformation. The carrier 132 can include a lubricious surface treatment, to further reduce interference and frictional forces during its insertion into and removal from the channel 42.

Figure 13:
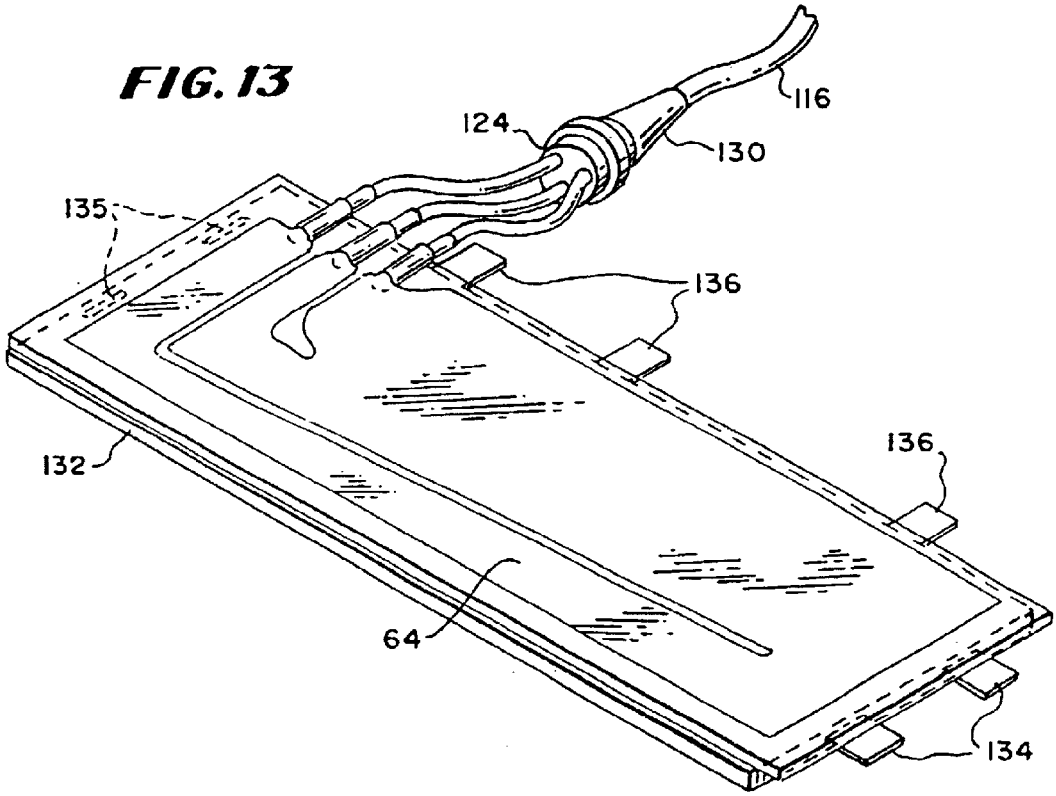
FIG. 13 and 14 are perspective views of a processing container shown in FIG. 4 when carried by a generally stiff carrier, which can be placed in a generally lay-flat condition for storage (FIG. 13) and rolled into a curved condition for insertion into the channel (FIG. 14)
Figure 14:
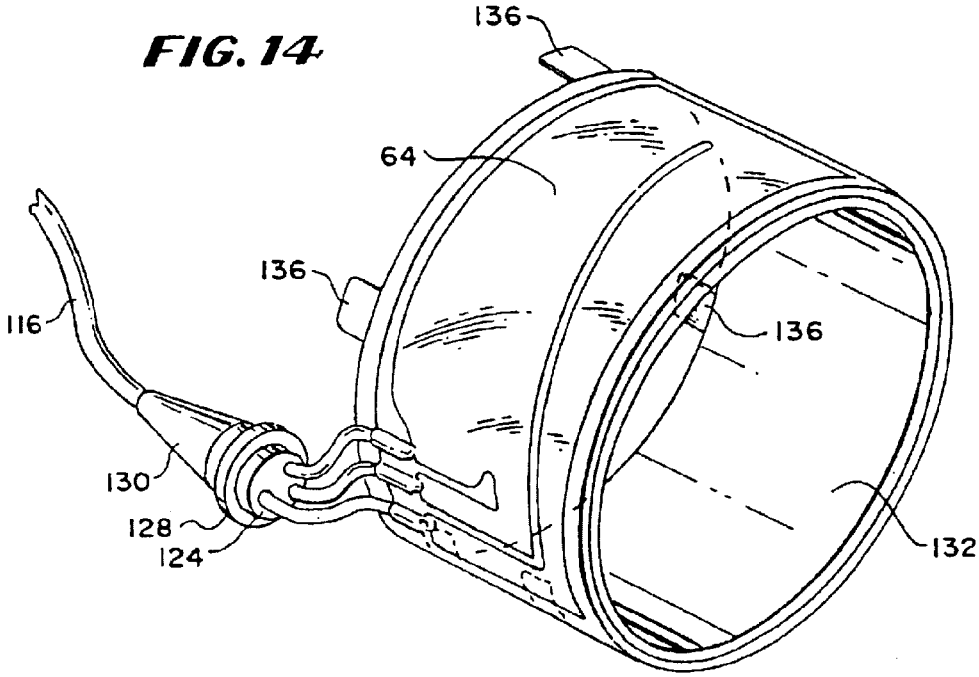

As FIGS. 12 A and 12 B show, the material of the carrier 132 can be pre-shaped in a normally rounded, three-dimensional geometry, which nests within the interior of the channel 42. Alternatively (as FIG. 13 shows), the carrier 132 can, if made from semi-rigid material, be maintained before use in a generally lay-flat conditioned. At the time of use (see FIG. 14), the carrier 132 is rolled end-to-end and secured, e.g., using end tabs 134 fitting into end slots 135, to form the rounded, three-dimensional shape, which conveniently slides into the channel 42 in the manner shown in FIG. 12B. The carrier 132 can include spaced side tabs 136 to aid in grasping, lifting, and lowering the carrier 132 with respect to the channel 42.

Figure 15:
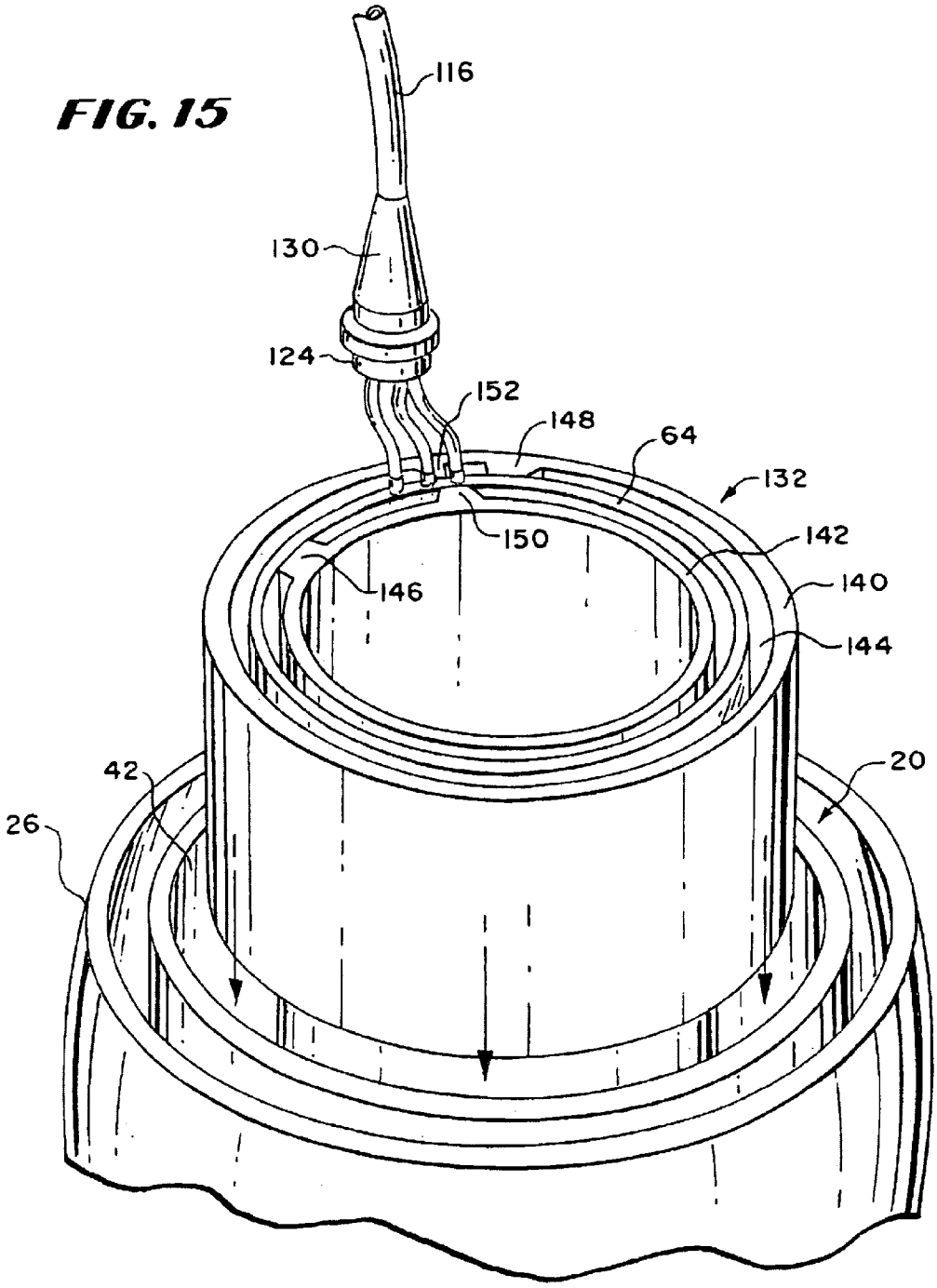
FIG. 15 is a perspective view of a slotted carrier, which carries a processing container shown in FIG. 4, to aid in its insertion into and removal from the channel of the centrifuge shown in FIG. 1.

As shown in FIGS. 12A/B to 14, the carrier 132 extends along only one side of the container 64. Alternatively, as shown in FIG. 15, the carrier 132 can itself form a slotted structure, comprising a front wall 140 and a rear wall 142, forming a slot 144 between them. In this arrangement, the container 64 is sandwiched in the slot 144 between the front and rear walls 140 and 142.

As FIG. 15 shows, the carrier walls 140 and 142 can include preformed contoured surfaces, for example, surfaces 146, 148, 150, and 152. When filled with blood and undergoing centrifugation, the sides of the container 64 press against the surfaces 146 to 152. The contoured surfaces 146 to 152 of the carrier 132 define the high-G and low-G contours desired for the separation zone.

For example, a first contoured surface 146 projecting outward from the rear wall 142 can define the PRBC barrier 100. A second contoured surface 148 projecting from the front wall 140 can define the tapered ramp 104. Third and fourth contoured surfaces 150 and 152 projecting outward from the front and rear walls 140 and 142 can mutually press against and support the interior seal 78, to protect the seal 78 against failure or leakage. The other contours shown in FIG. 6, and more, can likewise be formed using the carrier 132.

Figure 16:
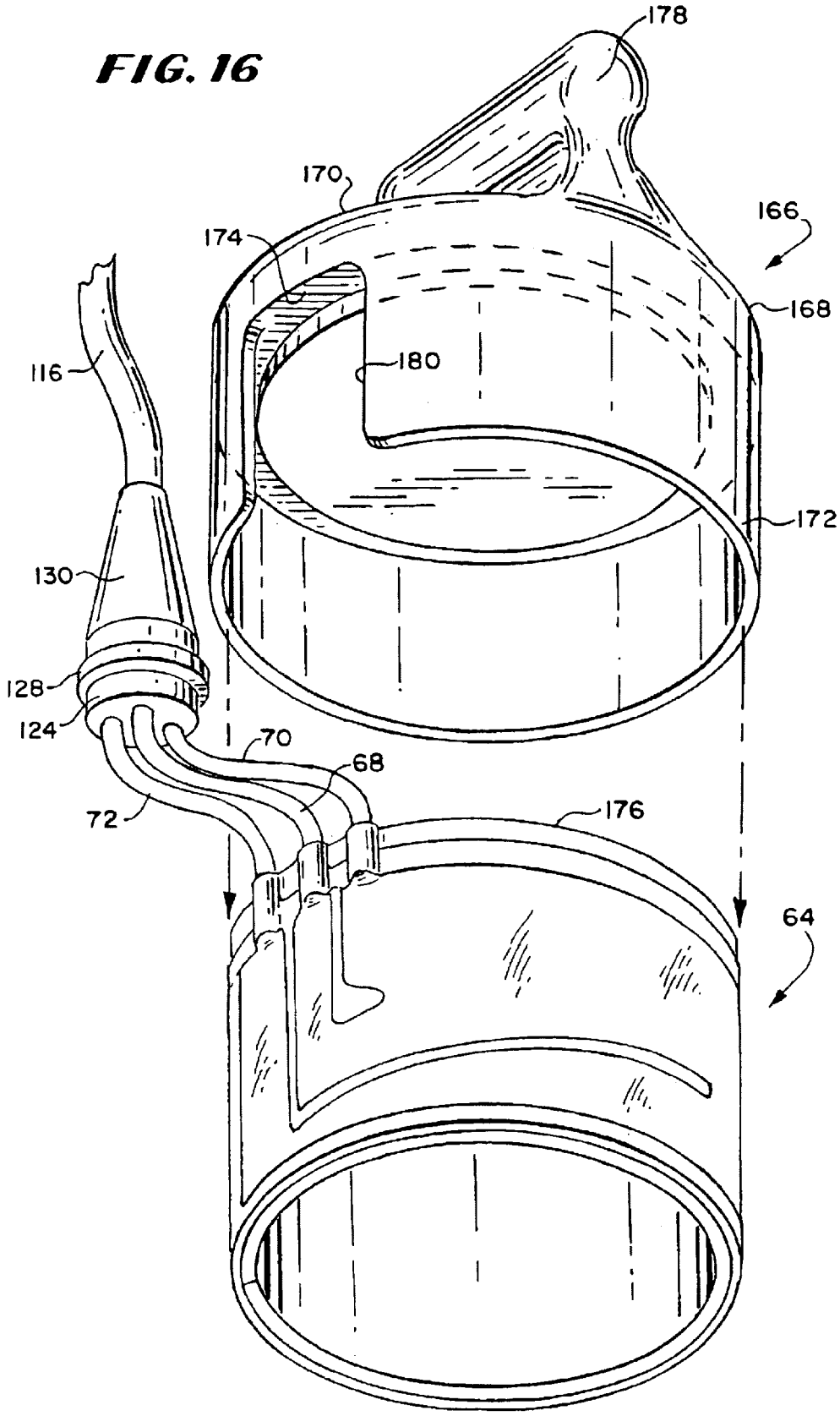
FIG. 16 is a perspective view of a tool intended to be fitted over the top of a processing container, as shown in FIG. 4, to aid its insertion into and removal from the channel of the centrifuge shown in FIG. 1.
Figure 17:
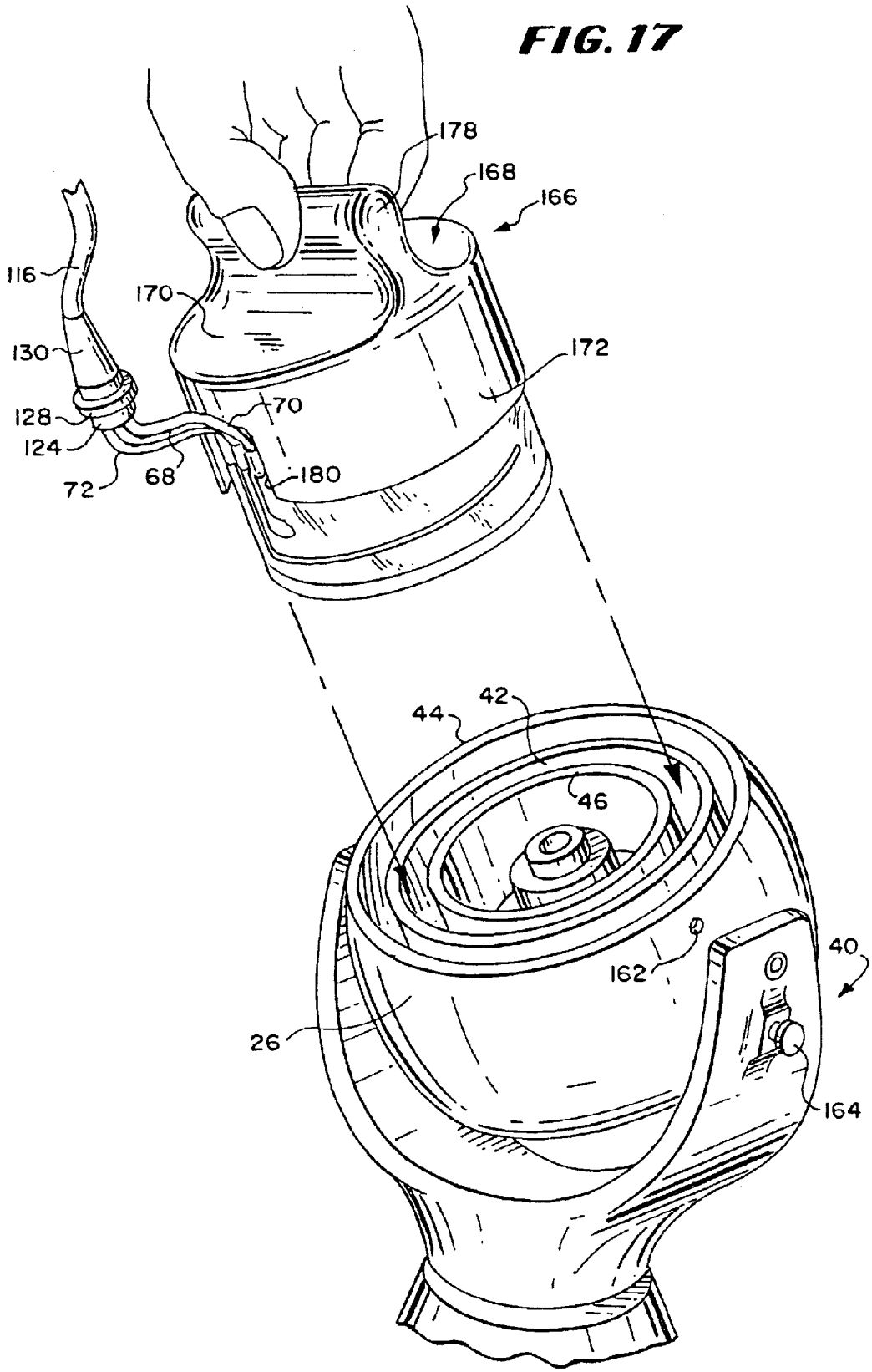
FIG. 17 is a perspective view of the tool shown in FIG. 16, when fitted to the processing chamber for use in inserting and removing the chamber into and from the channel of the centrifuge shown in FIG. 1.

FIGS. 16 and 17 show another alternative embodiment of a carrier 166 for the flexible processing container 64. In this embodiment, the carrier 166 comprises a cap 168 having a top wall 170 and a depending side wall 172 shaped to nest within the channel 42. The side wall 172 possesses mechanical properties that limit its deformation when subject to linear compression forces. Like the carrier 32, the side wall 172 can be formed, e.g., from molded plastic, vacuum-formed plastic, cardboard, or paper.

The top wall 170 includes an interior groove 174, which receives the top edge 176 of the container 64. The groove 174 generally corresponds to the shape of the side wall 172. Together, the groove 174 and the side wall 172 shape the container 64 into the desired normally rounded, three-dimensional geometry for placement into the interior of the channel 42 (as FIG. 17 shows). A region 180 of the side wall 172 is cut away to accommodate passage of the tubes 68, 70, and 72 coupled to container 64.

The side wall 172 depends a distance from the top wall 170 sufficient to impart stiffness to the container 42 and thereby prevent buckling or undue bending or shape deformation of the container 42 when inserted into the channel 64. The cap 168 is intended to be removed once the container 42 has nested in the channel 64, and can thereafter be re-engaged when it is time to remove the container 42 from the channel 64. In the illustrated embodiment, the top wall 170 includes an exterior grip 178 for the operator to grasp (see FIG. 17), to further facilitate insertion and removal of the container 64 into and from the channel 42. The carrier 132 can include a lubricious surface treatment, to further reduce interference and frictional forces during its insertion into and removal from the channel 42.

The centrifuge assembly 14 includes upper and lower mounts 156 and 158. The mounts 156 and 158 receive the umbilicus support blocks 122 and 124, previously described. The mounts 156 and 158 hold the umbilicus 116 (see FIGS. 1 and 2) in a predetermined orientation during use, which resembles an inverted question mark.

As FIG. 2 best shows, the upper umbilicus mount 156 is located at a non-rotating position above the chamber assembly 20, aligned with the rotational axis 62 of the assembly 20 when in its downward facing position. The lower umbilicus mount 158 is carried on the top of the chamber assembly 20, and is also aligned with the rotational axis 62. The lower umbilicus mount 158 is presented to the operator when the chamber assembly 20 is swung into its upward facing orientation. Thus, with the chamber assembly 20 in its upward facing orientation (shown in FIG. 3), the carrier 132 (holding the container 64) can be conveniently loaded into the channel 42. The umbilicus support block 122 can be loaded into the upper mount 156, just as the umbilicus support block 124 can be loaded into the exposed lower mount 158. The flanges 128 help orient the blocks 122 and 124 in their respective mounts 156 and 158.

When swung back into the downward facing orientation (see FIG. 2), the lower mount 158 holds the lower portion of the umbilicus 116 in a position aligned with the aligned rotational axes 60 and 62 of the yoke assembly 18 and chamber assembly 20. The mount 158 grips the lower umbilicus support 124 to rotate the chamber assembly 20 as the lower portion of the umbilicus 116 is rotated.

The upper mount 156 holds the upper portion of the umbilicus 116 in a non-rotating position above the yoke assembly 18. Rotation of the yoke base 22 brings a yoke arm 24 into contact with the umbilicus 116. This, in turn, imparts rotation to the umbilicus 116 about the rotational axis 60. Constrained by the upper mount 156, the umbilicus 116 also twists about its own axis 200 as it rotates. For every 180° of rotation of the first axle 28 about its axis 60 (thereby rotating the yoke assembly 180°), the umbilicus 116 will roll or twirl 180° about its axis 200. This 180° rolling component, when added to the 180° rotating component, cause the chamber assembly 20 to rotate 360° about its axis. The relative rotation of the yoke assembly 18 at a one omega rotational speed and the chamber assembly 20 at a two omega rotational speed, keeps the umbilicus 116 untwisted, avoiding the need for rotating seals. The illustrated arrangement also allows a single drive element 32 to impart rotation, through the umbilicus 116, to the mutually rotating centrifuge elements 18 and 20. Further details of this arrangement are disclosed in Brown et al U.S. Pat. No. 4,120,449, which is incorporated herein by reference.

Various features of the invention are set forth in the following claims.

We claim:

1. A blood processing assembly comprising an arcuate centrifuge channel defined between inner and outer walls which, in use, are rotated about a rotational axis to create a centrifugal field, an elongated processing container having a dimension measured about the rotational axis that is larger than a dimension measured along the rotational axis, the processing container also having flexibility and which, in use, occupies the arcuate centrifuge channel, tubing integrally connected to the processing container to convey blood from a source into the processing container to convey fluids within the arcuate centrifuge channel in a circumferential path about the rotation axis for separation in the centrifugal field, and a carrier secured to the processing container when outside the arcuate centrifuge channel and being shaped to maintain the processing container when outside the arcuate centrifuge channel in a rounded, flexed condition conforming to the arcuate centrifuge channel, the carrier limiting deformation of the processing container during insertion into or removal from the arcuate centrifuge channel.

2. A blood processing assembly according to claim 1 wherein the tubing includes an umbilicus.

* * * * *